United States Patent [19]

Fink et al.

[11] Patent Number: 4,505,190

[45] Date of Patent: Mar. 19, 1985

[54] PORTABLE MAINTENANCE EXHAUST HOOD

[75] Inventors: Carl M. Fink, West Simsbury; Edward C. Holman, Simsbury, both of Conn.

[73] Assignee: Nuclear & Environmental Protection, Inc., Hartford, Conn.

[21] Appl. No.: 369,502

[22] Filed: Apr. 19, 1982

[51] Int. Cl.[3] ..... F24F 11/00

[52] U.S. Cl. ..... 98/115.1; 138/97

[58] Field of Search ..... 98/115 VM, 115 R; 312/1, 3; 137/317, 315, 318; 138/97; 62/293; 150/52 R; 34/107; 128/1 R, 1 B, 205.26

[56] References Cited

U.S. PATENT DOCUMENTS

| | | | |
|---|---|---|---|
| 1,892,378 | 12/1932 | Bernstein | 128/205.26 X |
| 2,378,123 | 6/1945 | Beck . | |
| 3,041,957 | 7/1962 | Liptay . | |
| 3,096,933 | 7/1963 | Bora . | |
| 3,148,699 | 9/1964 | Shindler . | |
| 3,310,322 | 3/1967 | Carroll | 137/315 X |
| 3,492,987 | 2/1970 | Parker | 128/205.26 X |
| 3,518,991 | 7/1970 | Goss | 312/3 X |
| 3,745,991 | 7/1973 | Gauthier et al. . | |
| 3,875,853 | 4/1975 | Pielkenrood | 98/115 R X |
| 3,907,389 | 9/1975 | Cox et al. . | |
| 3,941,040 | 3/1976 | Carlson . | |
| 4,059,903 | 11/1977 | Piet et al. . | |
| 4,108,509 | 8/1978 | Piet et al. . | |

*Primary Examiner*—William E. Wayner
*Assistant Examiner*—J. Sollecito

[57] ABSTRACT

A portable exhaust hood isolates sections of piping for maintenance and repair. It has a transparent front panel to provide a clear viewing shield, which can be adjusted between open and closed positions. The use of a collapsible frame within an enclosure made of flexible material contributes significantly to the convenience and portability of the hood, and its relatively inexpensive construction permits disposal, as need be, without substantial economic detriment.

12 Claims, 9 Drawing Figures

PORTABLE MAINTENANCE EXHAUST HOOD

BACKGROUND OF THE INVENTION

In various industrial situations, it is frequently necessary to carry out maintenance and repair procedures upon installed pipes and other conduits without disassemblying them, and particularly on sections that include joints, valves and similar in-line fixtures. In many instances, and particularly at facilities such as nuclear and chemical plants, the performance of such work exposes personnel to serious hazards, such as from noxious and dangerous gases, liquids and particulates. While special clothing and headgear is widely utilized for the protection of individuals against such hazards, equipment of that nature is frequently quite uncomfortable and restrictive for the wearer, and tends to be rather expensive. Moreover, such individualized gear can, of course, provide no general protection for others in the vicinity, who might be exposed to the same conditions.

The practice of enclosing a section of conduit needing attention within a hood or like structure is described in the prior art, exemplary devices used for the purpose being shown in U.S. Pat. Nos. 2,378,123 to Beck and 3,148,699 to Shindler. Nevertheless, a substantial need remains for a portable enclosure that is effective to isolate the work site and provide protection for personnel in the vicinity, while permitting convenient access to the part under repair or maintenance.

Accordingly, it is an object of the present invention to provide a novel portable hood for containment of a conduit section or the like, so as to permit isolated maintenance and repair thereof under relatively safe conditions.

It is a more specific object of the invention to provide such a hood that will permit convenient access to the part under repair or maintenance, while minimizing exposure of the technician and others in the vicinity to risk.

A further object of the invention is to provide a hood having the foregoing features and advantages, which is also easy to assemble and disassemble, convenient to use, and relatively simple and inexpensive to manufacture.

Yet another object of the invention is to provide a novel portable maintenance hood system which affords the foregoing features and benefits.

SUMMARY OF THE DISCLOSURE

It has now been found that certain of the foregoing and related objects of the invention are readily attained in a portable exhaust hood, including an enclosure comprised of interconnected top, bottom, front, rear and end walls. The front wall is fabricated from a flexible transparent material, and has a generally transversely extending free edge portion adjacent either the bottom wall or the top wall. It is joined to the other of the two walls, to permit displacement from a closed position in which the free edge portion is disposed along the adjacent wall, to an at least partially open position spaced therefrom, thus providing a hand access and air ingress opening into the enclosure. The hood also has means for securing the front wall in its open and closed positions, means permitting the insertion of a section of an intact conduit into the enclosure, at least one opening at a point remote from the ingress opening for egress of air from the enclosure, and means for supporting the hood in an operative position about the conduit.

In the preferred embodiments, the front wall and top wall are integrally formed from a single piece of flexible transparent material, and the free edge portion of the front wall lies adjacent the bottom wall of the enclosure. Most desirably, the securing means provided will permit the front wall to be secured in a multiplicity of open positions, to enable the area of the ingress opening to be varied. The securing means will advantageously comprise a member extending continuously along the forward edges of each of the end walls, and will permit securement of the front wall at any position along the length thereof. Such securing means will conveniently comprise a two-part hook and loop-type fastener, one part of which will provide the continuous extending members, with the other part being disposed on the facing surfaces of the front wall along the corresponding margins thereof.

It is especially desirable that the front wall include a lower panel and an upper panel, with interengaging means on the outer surfaces thereof to secure the panels in face-to-face contact when the front wall is folded upon itself. Such interengaging means will also conveniently comprise a hook and loop-type fastener, with the coacting parts thereof being disposed on each of the panels and being aligned for interengagement when the front wall is in its folded condition. The use of an elongated continuous fastener is most desirable from the standpoint of permitting interengagement of the panels at any position along the effective length thereof.

Generally, the end walls will be inwardly slit from their forward edges to provide the means by which the conduit section can be inserted into the enclosure, and means will beneficially be provided to close the slits about the inserted conduit. At least one of the end walls may have an opening formed therethrough to provide the necessary air egress port from the enclosure, and the liquid and particulate drain will normally be provided by an opening in the bottom wall.

The end walls of the enclosure will beneficially be fabricated, at least in part, from a flexible material; in such a construction, the hood will desirably include a rigid framework to support the enclosure. Preferably, the framework will be at least partially collapsible, and may comprise laterally extending top and bottom members and upstanding end members conforming to, and cooperatively supporting, the walls of the enclosure, with the members being pivotably interconnected to permit collapse. Either the top or the bottom members may advantageously comprise a plurality of disengageable parts, to permit relative movement, and the end members at the forward side of the framework may be similarly constructed and pivotably attached to other members, to permit displacement and thereby enable insertion of the conduit into the enclosure.

Other objects of the invention are attained in an exhaust system comprising, in addition to the portable exhaust hood hereinbefore described, vacuum means operatively connected to the air egress opening and a waste collection container operatively connected to the drain. It may, in addition, include a stand for the hood, in which case the supporting means will adapt the hood for support thereby.

DETAILED DESCRIPTION OF THE ILLUSTRATED EMBODIMENTS

Figure 1:
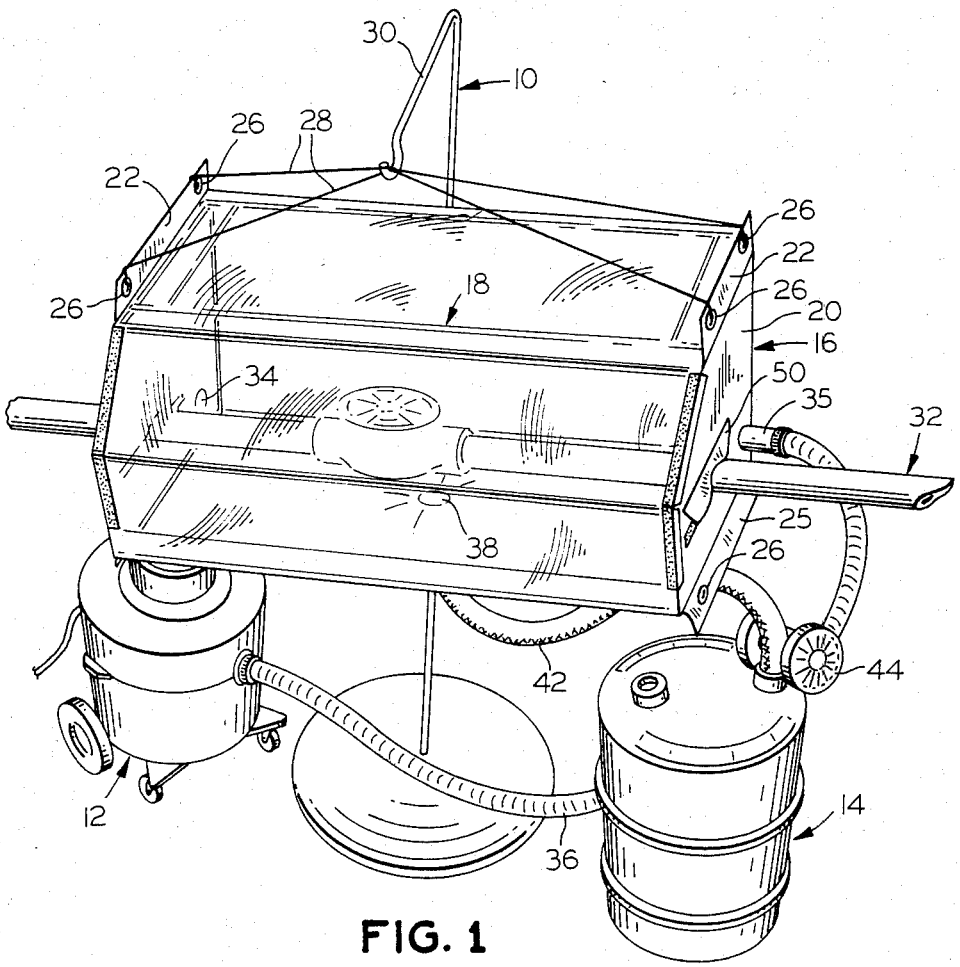
FIG. 1 is a perspective view of a system embodying the present invention, showing a section of a valved pipe enclosed within the hood thereof.

Turning now in detail to the appended drawings, FIG. 1 shows a system embodying the present invention and including a portable exhaust hood, which is supported upon a stand and has operatively connected to it a vacuum unit and a waste disposal container, the stand, vacuum unit and disposal container being generally designated by the numerals 10, 12 and 14, respectively. The hood consists of an enclosure, generally designated by the numeral 16, and an internal skeleton or frame, generally designated by the numberal 18. As can be seen, the end walls 20 of the enclosure 16 have flap-like extensions 22, 25 extending respectively along their upper and lower borders; the extensions are, in turn, provided with grommetted apertures 26. Wires 28, or the like, are attached to the enclosure through the apertures 26, and are used to hang the hood from the hooked post 30 of the stand 10. In this manner, the hood is supported about the valve-containing section of the pipe, generally designated by the numeral 32, so that it passes therethrough, as illustrated.

Each of the end walls 20 has an exhaust port 34, from about which extends a sleeve 35; conduit 36 from the vacuum unit 12 is clamped within one of the sleeves 35, and the other port 34 will normally be closed, such as by tying off the associated sleeve 35. A drain aperture 38 is formed through the bottom wall 24 of the enclosure, and it is connected to the disposal container 14 by a conduit 42. A filter unit 44 is mounted on the container 14 to prevent the escape of particulates and liquids therefrom.

Figure 2:
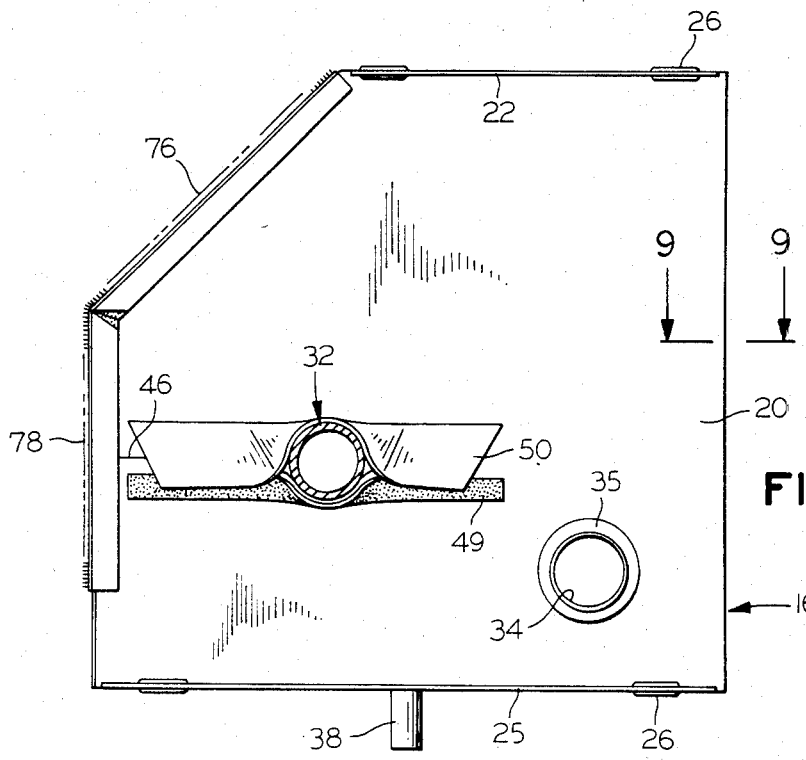
FIG. 2 is a side elevational view showing the hood of FIG. 1 with the pipe passing therethrough, drawn to an enlarged scale.
Figure 5:
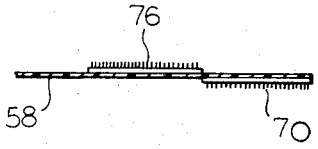
FIG. 5 is an enlarged sectional view of the marginal edge of the front wall, taken along line 5—5 of FIG. 4.
Figure 3:
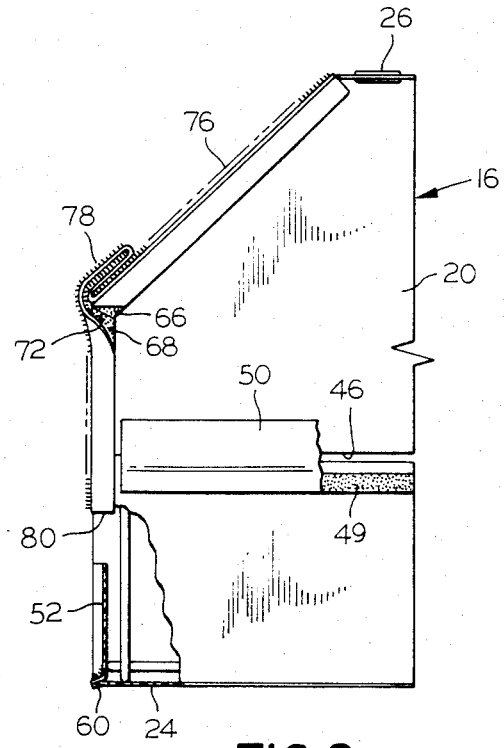
FIG. 3 is a fragmentary view similar to FIG. 2, with the pipe removed and with the front wall panel of the enclosure displaced to define an air ingress and hand access opening into the enclosure, a lower corner portion of the end wall of the enclosure being broken away to show internal construction.
Figure 4:
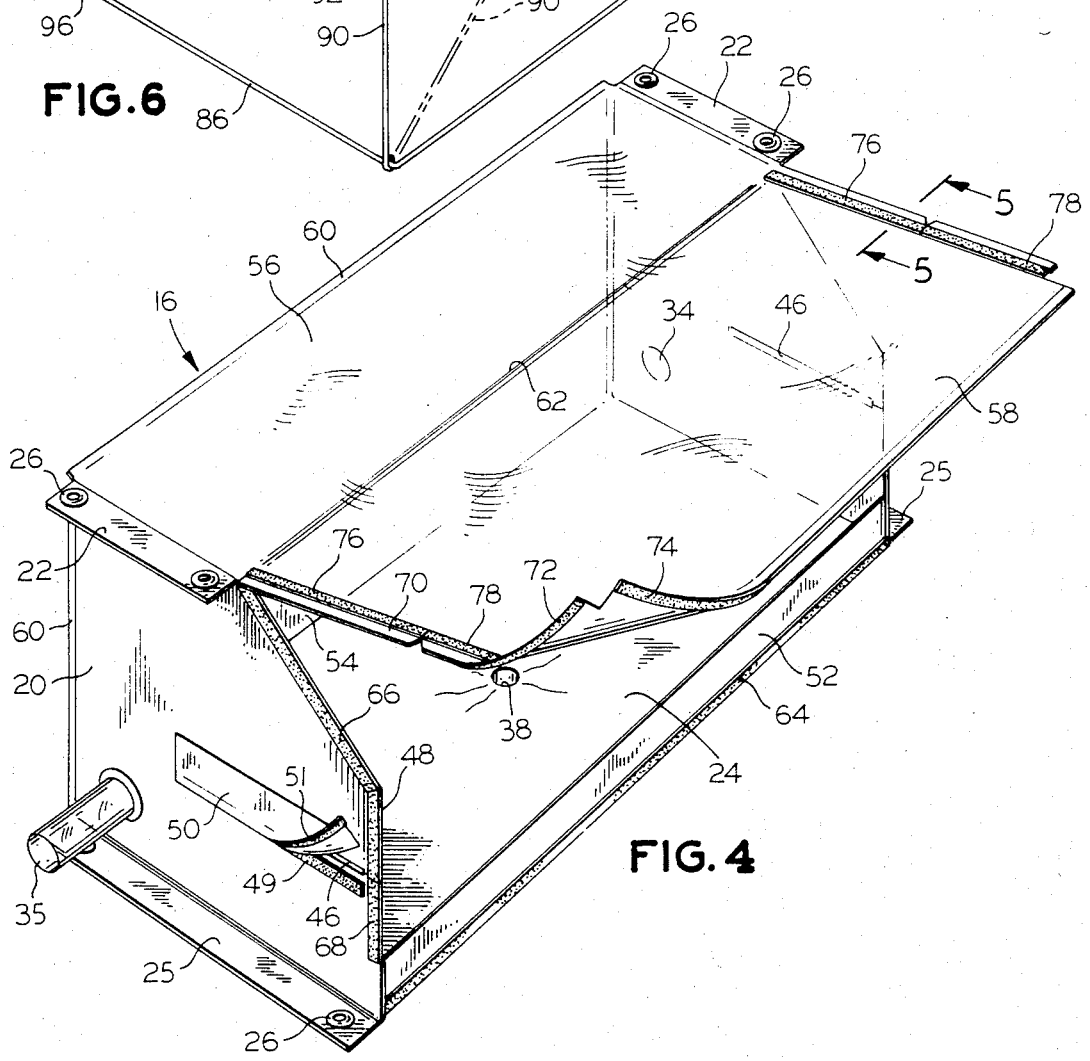
FIG. 4 is a perspective view of the hood of FIG. 1, with the internal frame removed and with the front wall of the enclosure fully disengaged from the end walls thereof.

As is best seen in FIGS. 2–4, the end walls 22 of the enclosure 16 are slit inwardly at 46 from the respective forward edges 48 thereof. A closure flap 50 is attached to the surface of the end wall 20 above each of the slits 46, and is dimensioned and configured to extend over the slit and to maintain it in a closed condition. A strip 49 of one part of a hook and loop-type fastener (e.g., Velcro) is provided on the wall beneath the slit 46 therein, and the flap 50 carries on the inner surface, adjacent its lower edge, the coacting part 51 of the fastener. The flaps 50 can therefore be used to secure the hood about the pipe 32 passing therethrough, as is best seen in FIG. 2 of the drawings.

Figure 9:
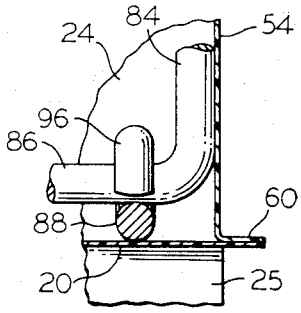
FIG. 9 is an enlarged fragmentary view, in partial section, taken along line 9—9 in FIG. 2 and showing the frame and its relationship to the end and back walls of the enclosure.

Together with the end walls 20 and the bottom wall 24, rear wall 54, top wall 56, and front wall 58 define the enclosure 16 of the hood. It should perhaps be noted here that the enclosure will generally be fabricated substantially entirely from a flexible materials, with the walls other than the top and front panels typically being of a reinforced plastic or canvas-like fabric, and with the top and forward walls desirably being made of a transparent plastic such as poly(vinyl chloride) or similar sheet material. The several walls or panels of the enclosure can be assembled by heat sealing them together along marginal seams, such as that which is most clearly shown at 60 in FIG. 9. In addition to the parts previously described, a narrow band 52 of material extends along the front of the enclosure and is attached along one side and at its ends to the bottom and side walls 24, 20, respectively. Similarly, the back wall 54 is attached to the same panels, and is of course also joined to the top wall 56. The latter is integrally formed with the front wall 58 as a single piece, which together provide the clear viewing shield that is necessary to permit ready observation of the work being performed within the enclosure. As will be appreciated, the top wall or panel 56 is considered to be that portion which is secured to the back wall 54 and the side walls 20 and the front wall panel 58 is regarded as that portion which is connected to the top panel along the hinge line 62.

Suitable fastening elements 72, 74 are provided on the remaining three sides of the panel 58 to enable securement along the forward edges 48 of the end walls 20, and beneath the band 52. Once again, the fastening means most advantageously utilized will be of the hook and loop type. By way of specific example, the fastener strips 66,68 on the margins of the forward edges 48 of the end walls 20 might suitably be provided by the loop-containing half of a Velcro fastener, as may the strip 64 extending beneath the transverse band 52. To cooperate therewith, strips 70, 72, 74, on the side and lower edge margins, respectively, of the front panel 58 would be provided by the hook-containing half of the fastener. The fastener parts 76, 78, which are disposed on the outside surface of the panel 58 inwardly of its laterial edges, would however together constitute a fastener unit; i.e., one of the strips 76,78 would comprise the hooks, and the other the loops thereof. This is important to enable the panel 58 to be folded upon itself and secured in that position, as shown in FIG. 3. It should be noted that the lower edge strip 74 is capable of attachment both to the traverse strip 64 and also to the marginal strips 68, thereby permitting secure attachment in the partially displaced position of the panel 58, as shown therein. Thus the lower part of the viewing shield can be disposed in virtually any position along the edge 48, with the area of the hand access and air egress opening 80 varying accordingly.

Figure 8:
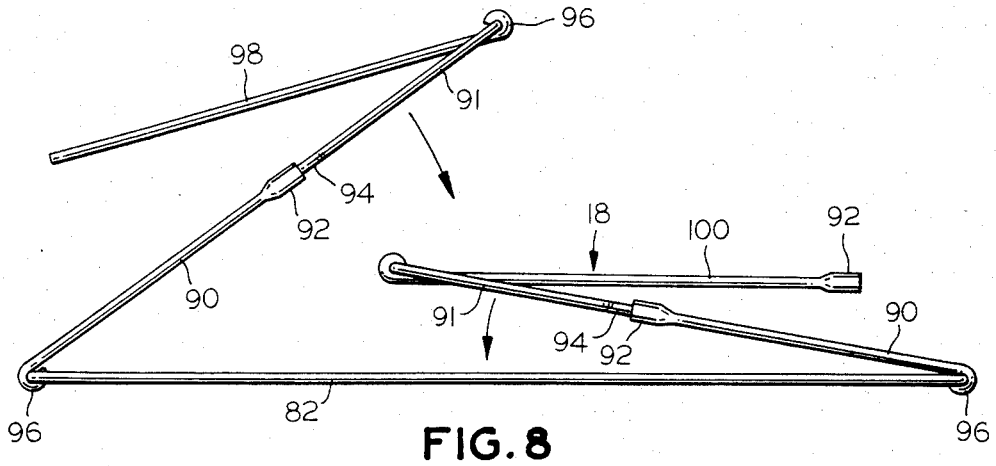
FIG. 8 is an enlarged front elevational view of the frame, showing it being collapsed from its erected condition.
Figure 7:
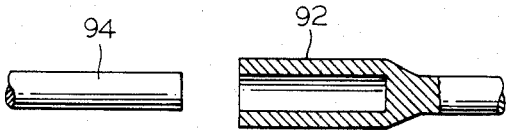
FIG. 7 is a fragmentary exploded view, in partial section, showing the construction of the end portions of the disengageable parts of the frame members, drawn to a greatly enlarged scale.
Figure 6:
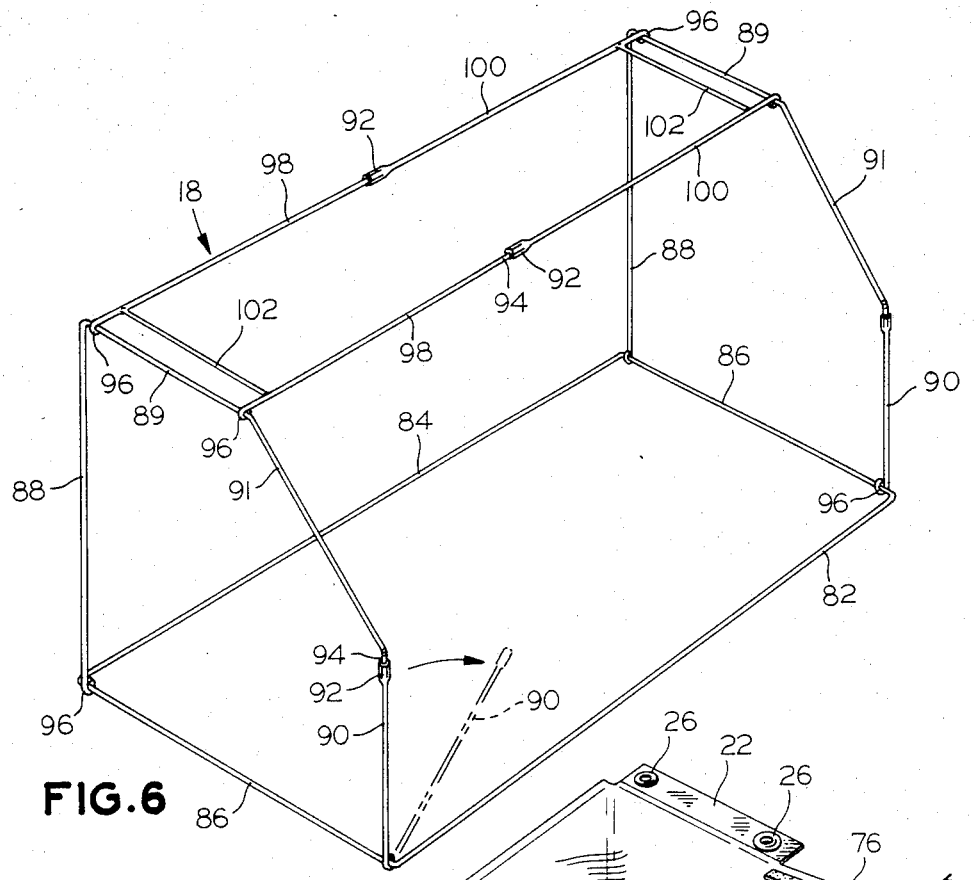
FIG. 6 is a perspective view of the frame utilized in the hood of the foregoing Figures, showing in phantom line the pivotable movement of one of the frame parts to permit insertion of the pipe into the enclosure.

Turning now to FIGS. 6–8 in greater detail, it will be noted that the frame 18 is constructed of rod stock that has been appropriately bent and provided with coupling means, to permit assembly in the configuration shown. It includes a rectangular base comprised of front, rear, and end elements 82, 84, 86, respectively, and side frame portions comprised of a compound member consisting of elements 88, 89 and 91, and a short post element 90. As is best seen in FIG. 7, the latter has an enlarged head 92 in which the end portion 94 of the compound member is frictionally engaged, and the lower ends of both parts are bent to form knuckles 96, which encircle the corresponding elements 86 and permit pivotable movement thereabout.

Similarly attached to the upper element 89 of the compound member is the top portion of the frame, consisting of lateral elements numbered 98 on one side and 100 on the other, the elements on each side being tied together by crosspieces 102. As will be noted, the elements 100 are provided with the enlarged head portions 92 to engage the end portions 94 of the elements 98, rendering the parts readily disengageable and relatively moveable, thus permitting the end frame portions to be folded inwardly, as shown in FIG. 8. Although the framework can therefore be dismantled with considerable ease, inadvertent collapse will be prevented by the constraint of the enclosure 16. It should be appreciated that an external frame might be used in place of the internal structure illustrated, if so desired, such as will minimize contamination of the framework and thereby avoid the need to decontaminate or discard it with undue frequency. The enclosure of the hood will, of course, normally be of relatively inexpensive construction, thus making it practical to simply discard it when it becomes excessively contaminated, typically after several usages.

While the stand shown in FIG. 1 provides a convenient means of support, and facilitates use of the hood in virtually any location, in some instances it may be desirable (such as in cramped quarters) to support the unit by other means. This may be accomplished, for example, simply by tying it to proximate fixtures or pipes, utilizing suitable strings or wires attached through the grommetted apertures 26 in the flap portions 22,25. In some instances, it may also be feasible simply to rest the hood upon underlying existing or added supporting structure.

As indicated hereinabove, the opening at the front of the enclosure is necessary not only to enable hand access thereinto, but also to permit air ingress for purging of the enclosure. For the latter purpose, it is especially desirable that the opening be of adjustable size, to ensure that a suitable (or, indeed, a mandated) airflow rate through the unit can be achieved despite variation in the capacity or effect of the vacuum system. Typically, applicable regulations require that a minimum airflow rate of 100 linear feet per minute be maintained, and the non-limited adjustablility of the front panel of the present hood makes it especially well-suited for use in applications in which such regulations are imposed. Although the hook and loop-type of fasteners are ideally suited for the purpose, other means, such as snaps and the like, can be utilized if so desired, as will be evident to those skilled in the art. In addition, the construction by which the front panel can be secured in a reversely folded condition (as shown in FIG. 3 of the drawings) is particularly advantageous, in that it avoids loose portions that might interfere, minimizes leakage, and contributes to the compactness and neat appearance of the hood.

While it is advisable to achieve fairly complete sealing of the enclosure in areas other than the front opening, it will be understood that the presence of gaps will not detract materially from the effectiveness of the hood, provided that an adequate vacuum effect is maintained. As long as a sufficient pressure differential exists, airborne discharges and leakage outwardly through such gaps will not occur; on the other hand, it will normally be desirable to minimize such gaps, to avoid risks attendant to the splashing of liquids. Finally, the ability to completely close the front opening (by engaging the strips 64 and 74) is significant from the standpoint of ultimate safety, and to permit personnel to leave the work site unattended temporarily.

Thus, it can be seen that the present invention provides a novel hood and system utilizing the same, by which repairs of contaminated piping systems are facilitated while isolating them to afford suitable protection for the repair technician. The linear airflow rate developed through the enclosure can readily be varied by adjusting the size of the access opening, and the unit is adaptable to multiple maintenance configurations and different field conditions. It is easy to assembly and disassemble, is readily positioned for use, and is very portable and disposable (if so desired), due to its lightweight and relatively simple and inexpensive construction. Provision is made not only for evacuating the enclosure, but also for removing liquids and solid particles discharged during the repair or maintenance operations, for suitable disposal.

Having thus described the invention, what is claimed is:

1. A portable exhaust hood for isolating a conduit section for maintenance and repair, including: an enclosure comprised of interconnected top, bottom, front, rear and end walls, at least said front wall being fabricated from a flexible transparent material and having a generally transversely extending free edge portion adjacent one of said bottom and top walls, said front wall being joined adjacent the other of said top and bottom walls, and being displaceable from a closed position with said edge portion disposed along said one wall, to an at least partially open position spaced therefrom, a hand access and air ingress opening into said enclosure thereby being defined; means for securing said front wall in said open and closed positions; means providing passages from an edge of at least one of said walls for permitting the insertion of a section of an intact conduit into said enclosure for extension therethrough; at least one opening at a point remote from said ingress opening for egress of air from said enclosure; and means for supporting said hood in an operative position about the conduit, said securing means comprising a member extending continuously along the forward edge margins of each of said end walls, permitting securement of said free edge portion at substantially any position along the length of said member to vary the area of said ingress opening comprising a two-part hook and loop-type fastener, one part of said fastener providing said continuously extending members and the other part thereof being disposed on the facing surface of said front wall along the corresponding margins thereof.

2. An exhaust system comprising: a portable exhaust hood for isolating a conduit section during maintenance and repair, said hood including an enclosure comprised of interconnected top, bottom, front, rear and end walls, at least said front wall being fabricated from a flexible transparent material and having a generally transversely extending free edge portion adjacent one of said bottom and top walls, said front wall being joined adjacent the other of said top and bottom walls, and being displaceable from a closed position with said edge portion disposed along said one wall, to an at least partially open position spaced therefrom, a hand access and air ingress opening into said enclosure thereby being defined, said hood also having means for securing said front wall in said open and closed positions, at least one air egress opening from said enclosure at a point remote from said ingress opening, a drain opening from said enclosure, and means for supporting said hood in an operative position about the conduit, said end walls being inwardly slit from the forward edges thereof, thereby providing passages for permitting the insertion of a section of an intact conduit into said enclosure for extension therethrough; vacuum means operatively connected to said air egress opening of said hood to permit evacuation of said enclosure; and a waste collection container operatively connected to said drain opening for effecting removal of particulates and liquids therefrom.

3. The system of claim 2 additionally including a stand for said hood, said supporting means of said hood adapting said hood for support by said stand.

4. A portable exhaust hood for isolating a conduit section for maintenance and repair, including: an enclosure comprised of interconnected top, bottom, front, rear and end walls, said front wall and said top wall being integrally formed from a single piece of flexible transparent material, and said front wall having a generally transversely extending free edge portion lying adjacent said bottom wall, said front wall being joined adjacent said top wall and being displaceable from a closed position, with said edge portion disposed along said bottom wall, to an at least partially open position spaced therefrom, a hand access and air ingress opening into said enclosure thereby being defined, said front wall also having a lower panel and an upper panel defined thereon with interengaging means on the outer surfaces thereof, said means serving to secure said panels in face-to-face contact with said front wall folded upon itself; means for securing said front wall in said open and closed positions; means providing passages from an edge of at least one of said walls for permitting the insertion of a section of an intact conduit into said enclosure for extension therethrough; at least one opening at a point remote from said ingress opening for egress of air from said enclosure; and means for supporting said hood in an operative position about the conduit.

5. The hood of claim 4 wherein said interengaging means comprises a two-part hook and loop-type fastener, one of the parts being disposed on each of said panels and being aligned for interengagement when said front wall is so folded.

6. The hood of claim 5 wherein said parts are elongated and continuous, and are disposed to permit engagement of said panels at substantially any position along the effective length thereof.

7. A portable exhaust hood for isolating a conduit section for maintenance and repair, including: an enclosure comprised of interconnected top, bottom, front, rear and end walls, at least said front wall being fabricated from a flexible transparent material and having a generally transversely extending free edge portion adjacent one of said bottom and top walls, said front wall being joined adjacent the other of said top and bottom walls, and being displaceable from a closed position with said edge portion disposed along said one wall, to an at least partially open position spaced therefrom, a hand access and air ingress opening into said enclosure thereby being defined; means for securing said front wall in said open and closed positions; at least one opening at a point remote from said ingress opening for egress of air from said enclosure; and means for supporting said hood in an operative position about the conduit, said end walls being inwardly slit from the forward edges thereof, providing passages for permitting the insertion of a section of an intact conduit into said enclosure for extension therethrough.

8. The hood of claim 7 wherein means is provided on said end walls to close said slits about the conduit inserted thereinto.

9. The hood of claim 7 wherein at least one of said end walls has an opening formed therethrough to provide said air egress opening.

10. The hood of claim 7 wherein said bottom wall has an opening formed therethrough to provide a liquid and particulate drain from said enclosure.

11. A portable exhaust hood for isolating a conduit section for maintenance and repair, including: an enclosure comprised of interconnected top, bottom, front, rear and end walls, at least said front wall being fabricated from a flexible transparent material and having a generally transversely extending free edge portion adjacent one of said bottom and top walls, said front wall being joined adjacent the other of said top and bottom walls, and being displaceable from a closed position with said edge portion disposed along said one wall, to an at least partially open position spaced therefrom, a hand access and air ingress opening into said enclosure thereby being defined, said end walls being at least partially fabricated from a flexible material; means for securing said front wall in said open and closed positions; means providing passages from an edge of at least one of said walls for permitting the insertion of a section of an intact conduit into said enclosure for extension therethrough; at least one opening at a point remote from said ingress opening for egress of air from said enclosure; means for supporting said hood in an operative position about the conduit; and a rigid framework rendering said hood self-supporting, said framework comprising laterally extending top and bottom members and upstanding end members conforming to and cooperatively supporting said walls of said enclosure, said members being pivotably interconnected to render said framework collapsible, said end members, at the forward side of said framework, being comprised of a plurality of elements disengageable from one another, at least one of said elements at each end of said framework being pivotably displaceable from other members to permit insertion of the conduit into said enclosure.

12. The hood of claim 11 where either said top or bottom member comprises a plurality of elements, said elements being disengageable from one another to permit relative movement of said end members, and thereby collapse of said framework.

* * * * *